US009976325B2

(12) United States Patent
Zolman et al.

(10) Patent No.: US 9,976,325 B2
(45) Date of Patent: May 22, 2018

(54) DOORWAY ENTRY PREVENTION DEVICE

(71) Applicants: Brandon Zolman, Fredericktown, OH (US); Rick Shaffer, Mt. Vernon, OH (US)

(72) Inventors: Brandon Zolman, Fredericktown, OH (US); Rick Shaffer, Mt. Vernon, OH (US)

( * ) Notice: Subject to any disclaimer, the term of this patent is extended or adjusted under 35 U.S.C. 154(b) by 0 days. days.

(21) Appl. No.: 15/355,640

(22) Filed: Nov. 18, 2016

(65) Prior Publication Data

US 2017/0138100 A1 May 18, 2017

Related U.S. Application Data

(60) Provisional application No. 62/257,013, filed on Nov. 18, 2015.

(51) Int. Cl.
*E05C 19/18* (2006.01)
*E05C 19/00* (2006.01)
*E05C 17/54* (2006.01)

(52) U.S. Cl.
CPC ..... *E05C 19/003* (2013.01); *E05C 17/54* (2013.01); *E05C 19/184* (2013.01); *Y10S 292/15* (2013.01); *Y10T 292/37* (2015.04)

(58) Field of Classification Search
CPC ..... E05C 17/44; E05C 17/443; E05C 17/54; E05C 19/003; E05C 19/007; E05C 19/008; E05C 19/18; E05C 19/184; E05C 19/188; E05B 63/0004; E05B 13/00; Y10S 292/15; Y10T 292/03; Y10T 292/301; Y10T 292/34; Y10T 292/37; Y10T 292/373;

(Continued)

(56) References Cited

U.S. PATENT DOCUMENTS 827,624 A * 7/1906 Foster ..... E05C 19/18 292/288
3,773,369 A * 11/1973 Wersonick ..... E05B 17/2023 292/150

(Continued)

FOREIGN PATENT DOCUMENTS

GB 2514787 A * 12/2014 ..... E05C 19/184

OTHER PUBLICATIONS

Chhuon, S., /news/education/newdevicepromisestoquicklylockdownschoolclassrooms, ABC10.com, webpage Nov. 7, 2014, 2 pages, USA.

(Continued)

*Primary Examiner* — Christine M Mills
(74) *Attorney, Agent, or Firm* — Standley Law Group, LLP; Adam Smith; Bradley Marzola

(57) ABSTRACT

The present invention is a system and method which comprises a rotating securing plate mounded on a door knob which engages a door frame to facilitate quickly securing a door to a door frame to protect the occupants of a room from an intruder. The system comprises a rotating stop in the doorknob which allows a user to open the door from within the secured room with a minimum of movements and time in the event of a dangerous situation in the room such as fire or other hazards. Through the use of an opening in the door frame, embodiments of the invention are equally applicable to doors that open inwardly and outwardly relative to an area to be secured.

5 Claims, 7 Drawing Sheets

(58) Field of Classification Search
CPC ..... Y10T 292/394; Y10T 292/42; Y10T 292/432; Y10T 292/444; Y10T 292/65; Y10T 292/67; Y10T 292/71; Y10T 292/73
USPC ... 292/1, 288, 275, 289, 290, 297, 298, 300, 292/302, 304, 338, 339, 342, 343, 292/DIG. 15
See application file for complete search history.

(56) References Cited

U.S. PATENT DOCUMENTS 4,082,334 A * 4/1978 Volta ..... E05C 19/003 292/288
4,159,838 A * 7/1979 Wilzig ..... E05B 17/2038 292/150
4,189,176 A * 2/1980 Hamilton ..... E05B 17/2023 292/1
4,254,976 A * 3/1981 Shoberg ..... E05C 19/182 292/258
4,334,705 A * 6/1982 Rumph ..... E05C 19/18 292/288
4,386,797 A * 6/1983 Duran, Sr. ..... E05C 19/182 292/292
4,503,692 A * 3/1985 Grint ..... E05B 13/001 16/402
4,575,140 A * 3/1986 Dargis ..... E05C 19/184 292/288
4,605,251 A * 8/1986 Finlay ..... E05C 19/18 292/147
4,770,450 A * 9/1988 Dacus ..... E05C 19/18 292/258
4,955,648 A * 9/1990 Miller ..... E05C 19/18 292/258
5,360,245 A * 11/1994 David ..... E05C 19/182 292/289
6,416,089 B1 * 7/2002 Williams, Jr. ..... E05C 19/182 292/288
6,487,751 B2 * 12/2002 Renaud ..... E05B 17/005 16/83
6,641,185 B2 * 11/2003 Hale ..... E05C 19/184 292/289
7,637,130 B2 12/2009 Carr
7,770,420 B2 * 8/2010 Carr ..... E05C 19/003 292/259 R
8,469,410 B2 * 6/2013 Wood ..... E05C 7/00 292/288
2002/0067046 A1 * 6/2002 Cox, Sr. ..... E05C 19/184 292/289
2003/0127867 A1 7/2003 Hale et al.
2006/0076786 A1 * 4/2006 Shaygan ..... E05C 19/184 292/288
2010/0102573 A1 4/2010 Rancatore
2014/0103668 A1 * 4/2014 McKinney ..... E05C 19/18 292/258
2014/0327249 A1 11/2014 Snyder
2014/0333075 A1 11/2014 Tarquinio
2015/0137534 A1 5/2015 Brunke et al.
2015/0204122 A1 7/2015 Edwards et al.

OTHER PUBLICATIONS

Classroom Secure Rapid Lock System, How it works, http://www.classroomsecure.com/how-it-works/, webpage, 2017, 2 pages, USA.
Matznick, J., Manistee Schools Increase Security With Nightlock Lockdown, https://nightlock.com/school-safety/ manistee-schools-increase-security-with-nightlock-lockdown/, webpage, Feb. 25, 2016, 3 pages, USA.
The Lockdown Co., http://thelockdownco.com/, webpage, Innovative Security Solutions, 2017, 3 pages, USA.
McMar Design LLC, The JAMBLOCK Safety System, About, http://www.lockdownschools.com/about/, webpage, 2013, 2 pages, USA.
The Bilco Company, Barracuda Products, http://www.bilco.com/foundations/store/storepage.asp?page=products, webpage, 2 pages, 2017, USA.
AMBITS, All American Security Devices, http://www.allamericansecuritydevices.com/#!lockdown-devices/c202h, webpage, 10 pages, accessed 2017, USA.

* cited by examiner

DOORWAY ENTRY PREVENTION DEVICE

CROSS-REFERENCE TO RELATED APPLICATION

This application claims priority to provisional application 62/257,013 filed on Nov. 18, 2015 and is incorporated by reference in its entirety as if fully recited herein.

TECHNICAL FIELD

Exemplary embodiments of the present invention relate generally to devices for preventing unauthorized entry to a classroom or other enclosed areas.

BACKGROUND AND SUMMARY OF THE INVENTION

As the result of an unfortunate number of school shootings in which an intruder has entered a school building with a firearm or other weapon, there is a need to be able to quickly secure a classroom or other door against intrusion. Various methods have been suggested that require modifications to the building or door structures including patent application numbers US 2015/0204122 and US 2015/0137534. Other methods require the existing door latch be set to a "locked" setting and prevent the door from latching completely until the invention is disengaged (patent application numbers US 2014/0333075 and 2010/0102573). Applicable fire safety requirements are of particular concern for devices that prevent the opening of a doorway used in public buildings such as schools. In order to be compliant with many such standards, an occupant of a locked room must be able to exit the room with a single action. For example, moving a door handle to an unlocked position as the occupant presses against the doorway in order to exit. What is needed is a device for securing a doorway that can easily be added to an existing door without significant modification of the door or building structure. Such a system should not require additional components that must be added to the door during use and ideally should not require more than a single movement to engage. In order to comply with fire code requirements, the system should not require more than a single movement to open the door in the event of a fire or other circumstance in which the secured area must be evacuated.

In an embodiment of the invention, a door securing plate may be mounted to a doorknob such that the plate may rotate about the shaft of the doorknob. In such an embodiment, the rotation of the plate may be restricted by frictional interference between the shaft and the plate such that the plate will remain stationary with respect to the door to which it is attached. When desired, the door securing plate may be rotated to a point at which it extends beyond the edge of the door. In certain embodiments of the invention, when the door securing plate is in such a position, a catch device may be engaged to fix the door securing plate in position relative to the doorknob. In addition to the door securing plate and catch device, embodiments of the invention may comprise a means for capturing the door securing plate in the door frame such that when the door securing plate is rotated to the point that it extends beyond the edge of the door that it enters such a means. Thus, when the door securing plate has been rotated and is captured by the capture means, the door may be prevented from opening, securing the occupants of the room against forced or other undesired entry. In an embodiment of the invention, when the door securing plate is fixed to the doorknob, an occupant of the room need only rotate the knob in the manner ordinarily used to release the latch and allow the door to open. Because the occupant isn't required to take any additional actions to release the door for exit, such an embodiment provides a significantly increased level of safety over known designs.

Further features and advantages of the devices and systems disclosed herein, as well as the structure and operation of various aspects of the present disclosure, are described in detail below with reference to the accompanying figures.

BRIEF DESCRIPTION OF THE DRAWINGS

In addition to the features mentioned above, other aspects of the present invention will be readily apparent from the following descriptions of the drawings and exemplary embodiments, wherein like reference numerals across the several views refer to identical or equivalent features, and wherein.

DETAILED DESCRIPTION OF EXEMPLARY EMBODIMENT(S)

Various embodiments of the present invention will now be described in detail with reference to the accompanying drawings. In the following description, specific details such as detailed configuration and components are merely provided to assist the overall understanding of these embodiments of the present invention. Therefore, it should be apparent to those skilled in the art that various changes and modifications of the embodiments described herein can be made without departing from the scope and spirit of the present invention. In addition, descriptions of well-known functions and constructions are omitted for clarity and conciseness.

Figure 1:
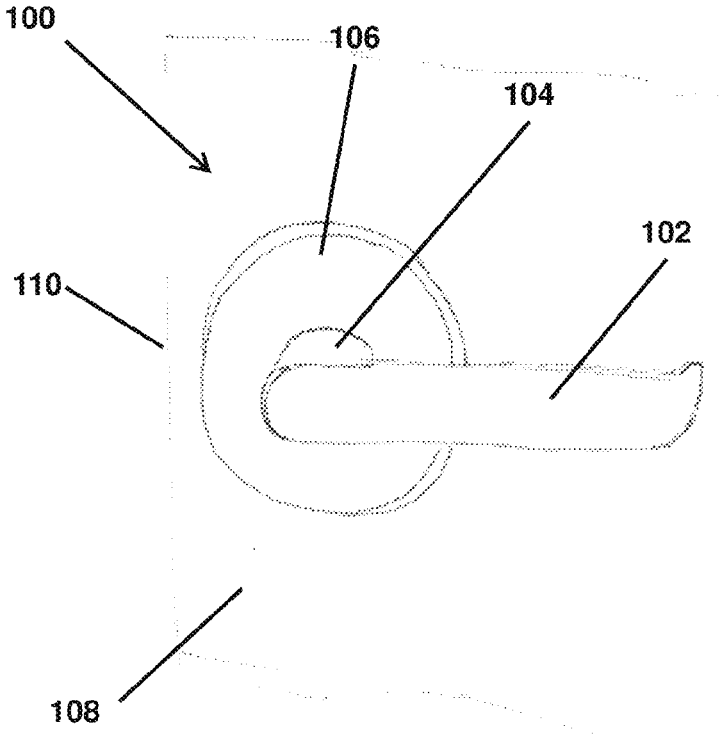
FIG. 1 is an illustration of a known ADA compliant door handle shown mounted on a door.

As is illustrated in FIG. 1, a known embodiment of an Americans with Disabilities Act (ADA) compliant door knob 100 may be comprised of a door handle 102, a handle shaft 104 and a mounting plate 106. As illustrated, when in use, such a handle is generally mounted to a door 108 near the edge of the door 110 which makes contact with a door frame 208 (not shown in FIG. 1).

Figure 2:
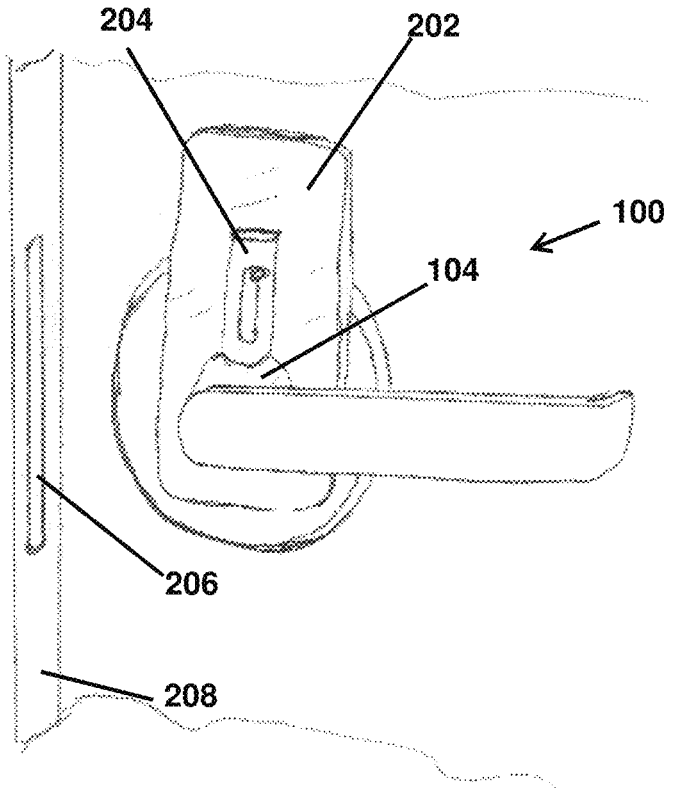
FIG. 2 is an illustration of an embodiment of the invention in a non-active position.
Figure 3:
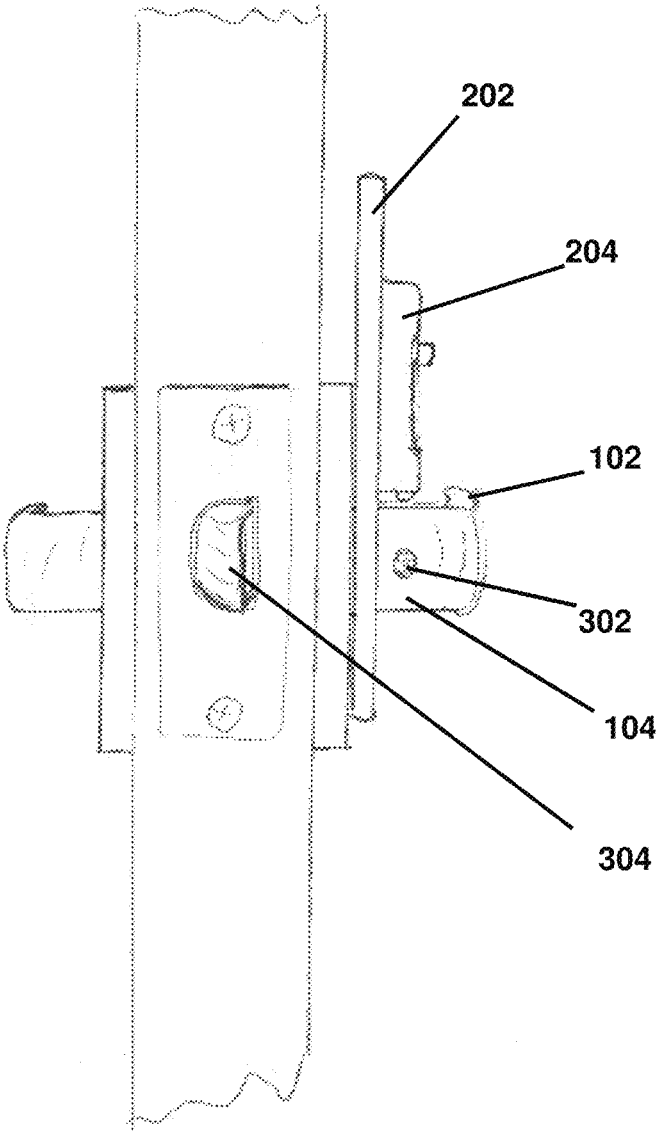
FIG. 3 is a side view of an embodiment of the invention in a non-active position.

Referring to FIG. 2, an embodiment of the invention may comprise a door securing plate 202 mounted on the handle shaft 104 of a doorknob 100. As illustrated, embodiments of the invention may also comprise a securing latch 204 that may be held in an unlatched position when the door securing plate is not in an active position as is illustrated in FIG. 2. FIG. 3 illustrates a side view of such an embodiment. As shown, the door securing plate 202 is illustrated in a disengaged position. Also shown is an engagement hole 302, which may be engaged by the securing latch 204 when the door securing plate 202 is in the active position. The door securing plate 202 may be fabricated from a rigid material such as, but not limited to steel or aluminum and should be of sufficient thickness so as to avoid deformation when force is applied to the door 208.

Figure 4:
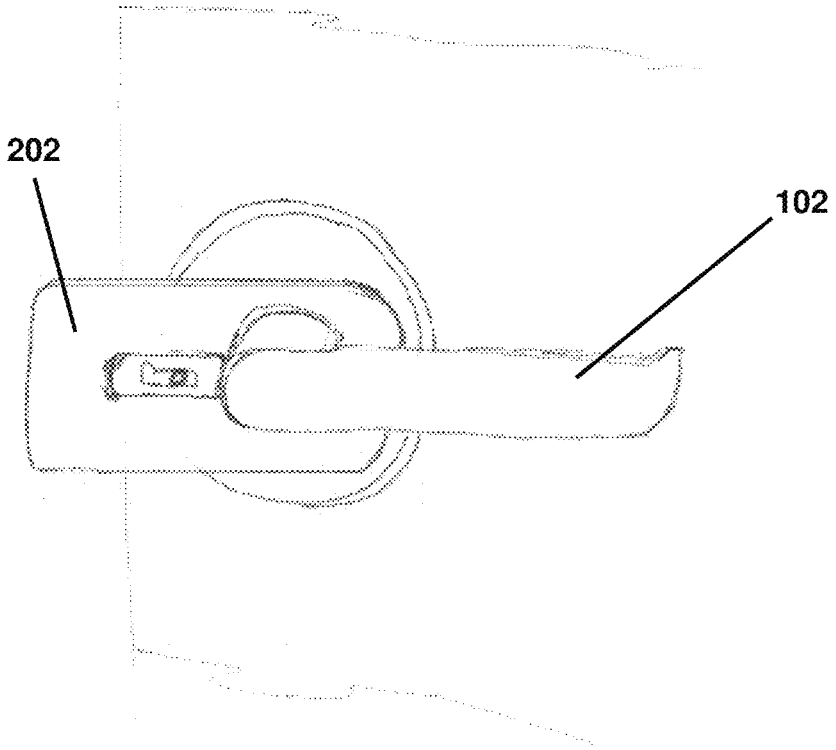
FIG. 4 is an illustration of an embodiment of the invention in an active securing position.

When an occupant or other user wishes to engage the door securing plate 202, such a person may rotate the plate such that the securing latch 204 engages with the engagement hole 302. Once so engaged, the door securing plate may be fixed in a position opposite the handle 102 as illustrated in FIG. 4.

Figure 5:
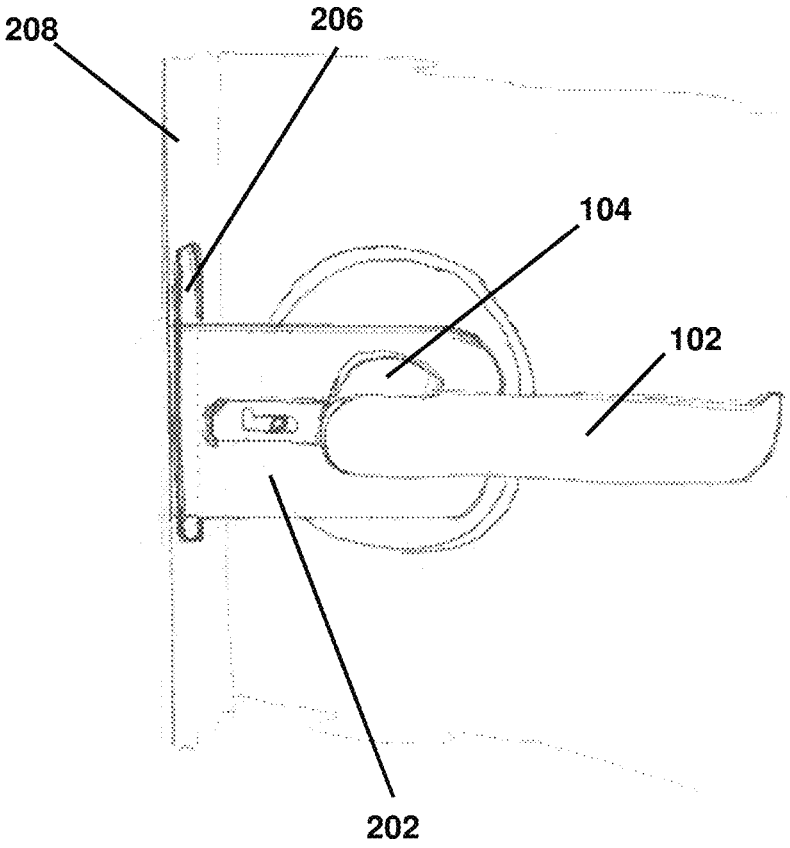
FIG. 5 is an illustration of an embodiment of the invention illustrated as engaged in a door frame capture slot.

When installed on a door which is mounted in a door frame, a slot may be required to be formed in the door frame in order to capture the door securing plate. Such a slot may need to be open at the top and bottom such that the door securing plate may enter the slot when an occupant of the room rotates the plate from the disengaged position illustrated in FIG. 2 to an engaged position as illustrated in FIG. 4. Such a slot is shown at 206 in FIG. 5. As shown, the slot 206 may be positioned in the door frame 208 such that the slot is located approximately opposite of the door handle shaft 104. The slot 206 may be aligned such that it is aligned with the plane of the securing plate 202 to permit the plate to be easily rotated into the slot when place in the engaged position as illustrated in FIGS. 4 & 5. The use of a slot such as illustrated may allow the door securing plate 202 to be installed on either side of a door (the hinged or non-hinged side) depending upon the orientation of the door relative to the area to be secured against intruders. For example, on a door that opens into the area to be secured, the invention would be installed onto the hinge side of the door and resist attempts to push the door into the secured area. When installed on a door that opens out of the secured area, the invention would be installed on the non-hinge side of the door and resist attempts to pull the door open. Embodiments of the invention may also include a frame to be mounted such that it surrounds the slot 206 to further strengthen the door frame as well as provide a decorative element to disguise the slot.

When installed in such a manner, a user may rotate the door securing plate such that it enters a slot 206 formed in a door frame 208. Once the door securing plate is positioned within the slot 206, the door will be prevented from opening. A preferred ADA compliant doorknob 100 may be configured such that when the door knob is locked, and the opposite (outer) handle (not shown) is rotated, the inner handle remains stationary. In other words, the actions of each handle are independent, with either handle being able to engage the latch 304 (see FIG. 3) and open the door. In such a configuration, the door securing plate 202 will remain engaged in the slot 206 even if the outer handle is rotated because it is not tied to the latch 304. This configuration will serve to prevent the door from being opened until the securing plate 202 is rotated such that it disengages from the slot 206. In such a configuration, locking of the door handle is not required. As such, when a doorknob is not locked, or inadvertently unlocked, the invention may be used to secure a room much more quickly than a device that requires the doorknob to be locked.

Figure 6:
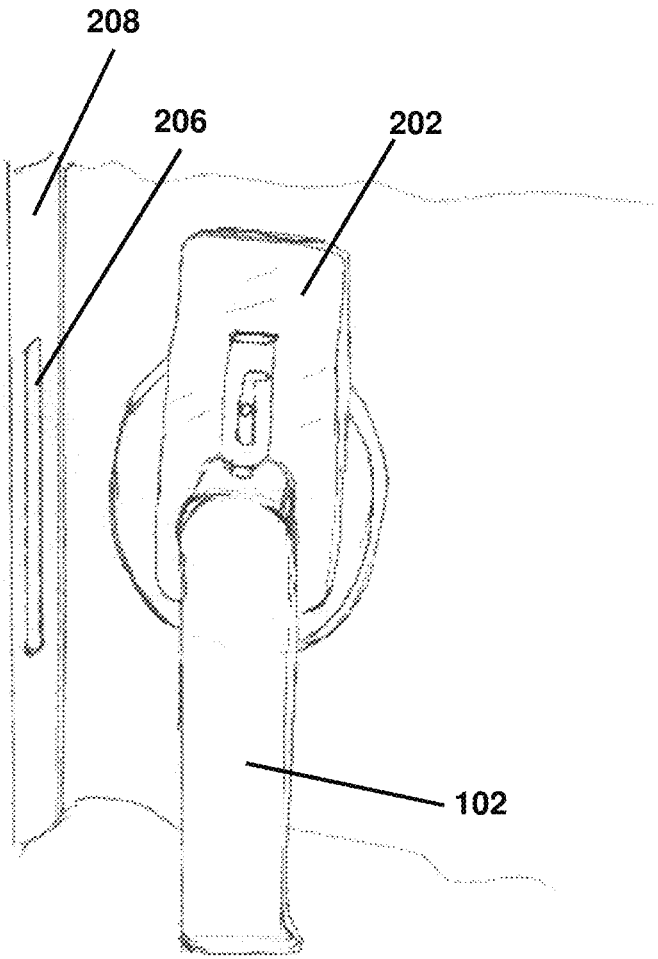
FIG. 6 is an illustration of an embodiment of the invention illustrated in a single motion disengagement position.

A key feature of the current invention is that the door securing bar is configured such that the securing latch in conjunction with the engagement hole 302 maintains the door securing plate 202 in a position that is relative to the handle 102. This allows a user to quickly and easily disengage the door securing plate 202 from the slot 206 in the door frame. As is illustrated in FIG. 6, in a situation such as a fire, a user may be able to grasp the door handle and rotate it to a position that both disengages the door latching hardware but also the door securing plate 202. As is shown, a user has rotated the door handle 102 to a position that is approximately vertical. The door securing plate 202 has also rotated to a vertical position such that it is no longer engaged by the slot 206 formed in the door frame 208. Once the door latching hardware and the door securing plate 202 have been disengaged, a user may simply push or pull the door open depending upon its configuration.

Figure 7A:
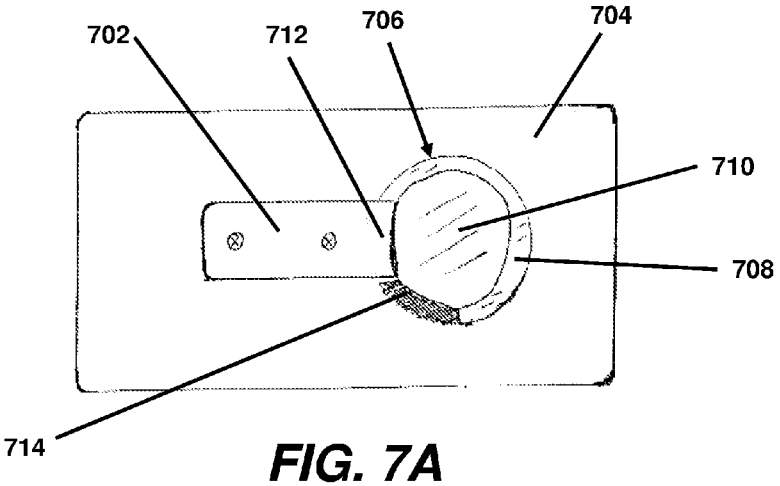
FIGS. 7A and 7B are illustrations of an embodiment of the invention that employs a stop device to locate the securing plate.
Figure 7B:
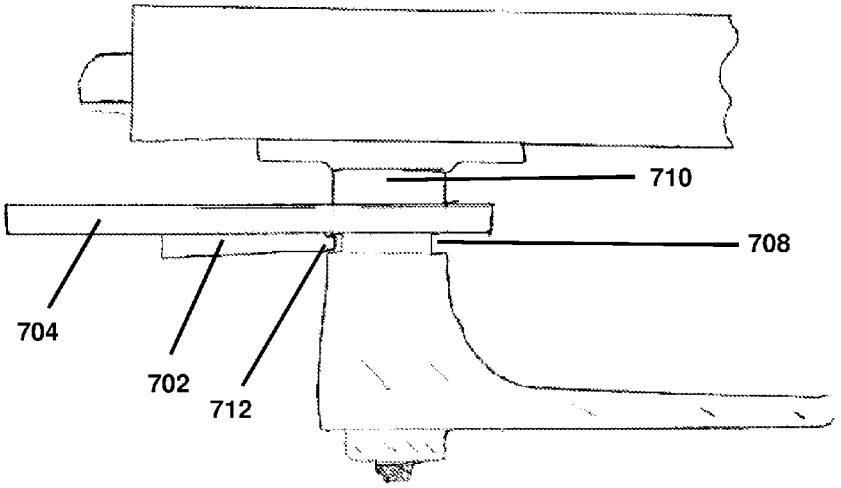

In another embodiment of the invention, the opening formed in the securing plate may be configured to freely rotate into the securing position and then be held in alignment by a stop formed in the door handle shaft. As is illustrated in FIG. 7A, a stop 702 is affixed to the securing plate 704 adjacent to the opening 706. This stop rides in a groove 708 formed in the handle shaft 710 (illustrated in a cross-section view). When the door to which the invention is affixed is desired to be secured, a user may rotate the securing plate 704 into an engaged position (similar to what is illustrated in FIG. 5). As is shown in FIG. 7B, a tab portion 712 the stop 702 engages with a non-grooved portion 714 of the handle shaft 710 and thus prevents the securing plate 704 from rotating past the engaged position. The stop may also function to align the securing plate 704 onto the handle shaft as the tab 712 formed in the stop may engage the groove 708 such that the securing plate is prevented from moving into a position of misalignment.

Any embodiment of the present invention may include any of the optional or preferred features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to the described invention. Many of those variations and modifications will provide the same result and fall within the spirit of the claimed invention. It is the intention, therefore, to limit the invention only as indicated by the scope of the claims.

What is claimed is:

1. A door handle mounted door securing system comprising:

a door handle located on a door;

a handle shaft located near an end of the door handle;

a door frame comprising a vertical slot located at substantially the same vertical height from the ground as the door handle;

a securing plate having a first end and a second end and comprising an opening formed near the first end, said opening being larger than the handle shaft and smaller than the door handle, said opening positioned on the handle shaft such that the handle shaft passes through the opening, the opening completely encircling the handle shaft such that the securing plate is configured to rotate about the handle shaft;

a securing stop affixed to a front surface of the securing plate; and a groove formed in the handle shaft wherein the groove does not completely encircle the handle shaft such that there is a grooved portion of the handle shaft and a non-grooved portion of the handle shaft;

wherein the securing stop abuts the non-grooved portion of the handle shaft when the securing plate is located in a first position;

wherein the securing stop is received in the grooved portion of the handle shaft when the securing plate is located in a second position; and wherein the securing plate is sized such that the second end extends within the vertical slot when the securing plate is rotated into the first position and the second end is positioned completely outside of the vertical slot when the securing plate is rotated into the second position.

2. The system of claim 1, wherein the securing stop comprises a tab adapted to be positioned into the groove formed in the handle shaft, wherein said tab is configured to frictionally engage the non-grooved portion of the handle shaft when said door handle is rotated into the first position.

3. The system of claim 1, where the securing plate is formed from a rigid material.

4. The system of claim 3, where the securing plate is formed from steel.

5. The system of claim 1, where the opening of the securing plate is configured such that there is a level of friction between the securing plate and the handle shaft such that the securing plate remains in a fixed position relative to the handle shaft unless a user rotates the securing plate to another position relative to the handle shaft.

* * * * *